United States Patent [19]

Wedeking et al.

[11] 4,305,774

[45] Dec. 15, 1981

[54] APPARATUS FOR PLACING A PLASTIC STRIP AROUND OBJECTS

[75] Inventors: Werner Wedeking, Küsnacht; Hans Wüthrich, Wettswil, both of Switzerland

[73] Assignee: Borbe-Wanner AG, Dietikon, Switzerland

[21] Appl. No.: 145,830

[22] Filed: May 1, 1980

[30] Foreign Application Priority Data

May 11, 1979 [CH] Switzerland ..... 4426/79

[51] Int. Cl.[3] ..... B23K 27/00; B29C 27/08

[52] U.S. Cl. ..... 156/494; 100/33 PB; 156/73.5; 156/580

[58] Field of Search ..... 100/33 PB; 156/73.5, 156/494, 495, 580

[56] References Cited

U.S. PATENT DOCUMENTS

| | | | |
|---|---|---|---|
| 3,554,845 | 1/1971 | Billett et al. | 100/33 PB |
| 3,554,846 | 1/1971 | Billett | 100/33 PB |
| 3,654,033 | 4/1972 | Angarola et al. | 156/494 |
| 3,709,758 | 1/1973 | Gilmore | 156/580 X |
| 3,732,613 | 5/1973 | Steigerwald | 29/470.3 |
| 3,799,835 | 3/1974 | Gilmore | 156/580 |
| 3,984,278 | 10/1976 | Styner | 156/580 X |
| 4,096,019 | 6/1978 | Lehmann | 156/494 |

*Primary Examiner*—John E. Kittle

[57] ABSTRACT

A male die shaft is mounted in a longitudinally movable and rotary manner in a casing. A lever engages on the said shaft. By means of a motor driven cam, the lever is pivoted. By means of a coupling operable by a shift lever and by means of a gear, a tensioning wheel is motor-driven for tensioning the strip. The male die shaft is held in the raised position by a stop member operated by a stop lever. The shift lever and the stop lever are part of a control mechanism pivotably mounted on a shaft and which is operated by a feeler lever. As a result, the coupling and stop member are released and the male die shaft is lowered onto the strip ends. By means of a lever driven by a cam, male die shaft performs a pivoting movement transmitted via a tooth wheel drive to a shaft which imparts an oppositely directed pivotal movement onto a female die located in the base plate. The movement resulting from the pivoting movement of the strip portions produces the frictional heat necessary for welding purposes. By means of the common control mechanism and the non-couplable male die shaft a simple construction of the apparatus is obtained.

8 Claims, 4 Drawing Figures

APPARATUS FOR PLACING A PLASTIC STRIP AROUND OBJECTS

BACKGROUND OF THE INVENTION

The invention relates to an apparatus for placing a plastic strip around objects and for welding together its overlapping strip portions arranged so as to be displaceable relative to one another to produce heat by a male die mounted in a casing and a female die positioned in a base plate.

Various constructions are known for sealing a plastic to objects by welding, preferably by friction welding. It is common to all these constructions that the overlapping plastic portions are placed between two jaws, called the male die and the female die, after which the jaws are pressed together and moved counter to one another. Due to the movements of the jaws under pressure, the overlapping strip portions are moved against one another so as to soften and partly melt the engaging surfaces of the strip portions in such a way that they form an intimately connected, welded member. The movement of the jaws is brought about in various ways, for example by displacing the overlapping strip portions in the longitudinal direction of the strip (U.S. Pat. Nos. 3,799,835 and 3,984,278) or by a circular movement (U.S. Pat. No. 3,709,758).

The disadvantage of the known constructions is that although they bring about a relatively rapid welding of the overlapping strip portions the construction procedure is relatively complicated and costly and in particular a relatively large number of movable and moved parts are used.

BRIEF SUMMARY OF THE INVENTION

The problem of the invention is to so develop an apparatus for sealing a plastic strip on objects of the type described hereinbefore that a relatively simple construction is obtained, so that relatively few moving parts have to be provided.

According to the invention, this problem is solved in that the male die fixed to a male die shaft is pivotable about the male die axis by a lever which acts on the male die shaft and which is reciprocatable at its free end, the male die shaft being displaceably mounted with respect to the lever in the casing.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
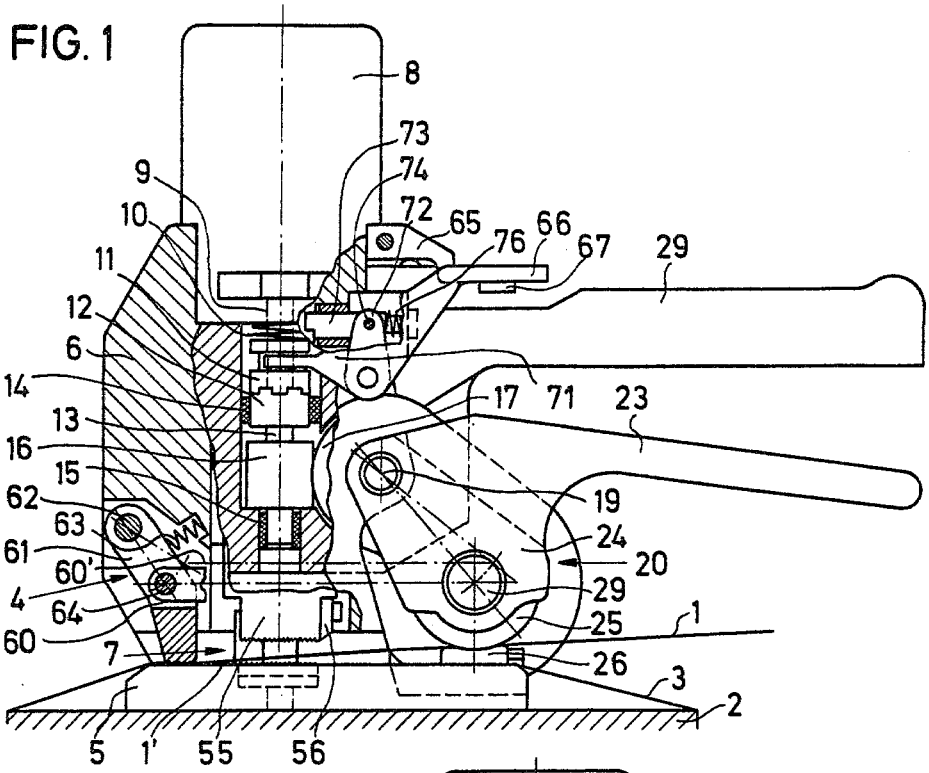
FIG. 1 is a side view of the apparatus for sealing a plastic strip to articles with members shown partly in section.

FIG. 1 shows an apparatus for sealing a plastic strip wound around an object 2 and whose end 3 extends into the vicinity of a strip clamping device 4. The apparatus has a base plate 5 and a casing 6 which is joined to the base plate 5. Between base plate 5 and casing 6 which is connected thereto, of particularly FIG. 2, is provided a strip channel 7 in which are placed the overlapping strip portions 1' for sealing purposes.

To casing 6 is fixed a motor drive 8, e.g. an electric or compressed air motor, on whose driving shaft 9 is fixed a coupling member 11 loaded by a compression spring 10 so as to be displaceable and drivable. Coupling member 11 forms one half of a claw coupling, whose other coupling member 12 is connected to a worm shaft 13. Shaft 13 with the other coupling member 12 is pivoted in bearings 14, 15. On worm shaft 13 is located a worm 16 which meshes with a worm gear 17. The latter is fixed to a shaft 18 mounted in casing 6 and by means of a bearing in a casing attachment 21 and whose axis 19 forms the pivot axis for a rocker 20 (FIG. 2). Rocker 20 comprises a rocker lever 23 joined to the rocker casing 24, a tension wheel 25 for tensioning strip 1 or strip portion 1' with the aid of a tension shoe 26 and the drive required for driving the tensioning wheel 25. The drive comprises a gear wheel 27 fixed to shaft 18 and a gear wheel 28 fixed to a shaft 29, tensioning wheel 25 being fixed to shaft 29. A handle 29' is joined to casing 6 and makes it possible to carry the said apparatus.

Figure 2:
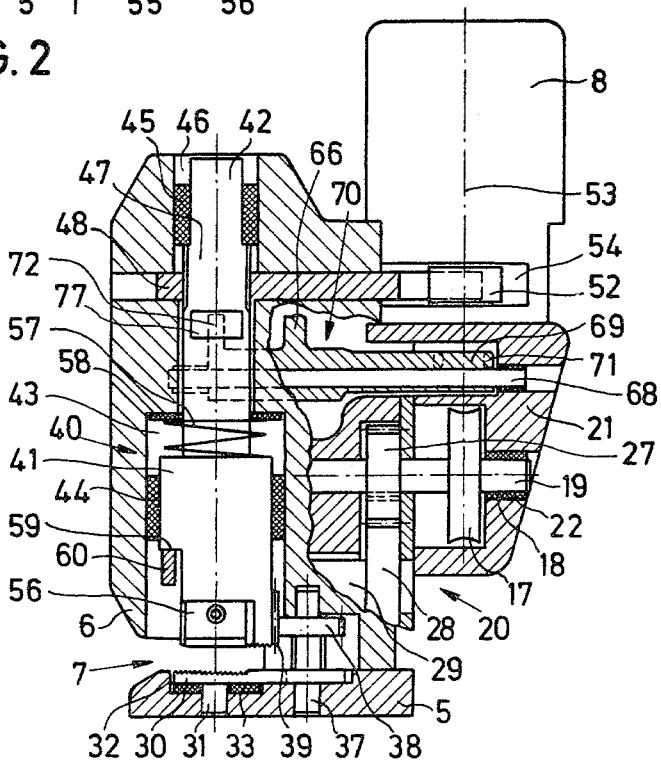
FIG. 2 a vertically presented section through the apparatus of FIG. 1 at right angles to the strip channel with two displaced sectional planes.
Figure 3:
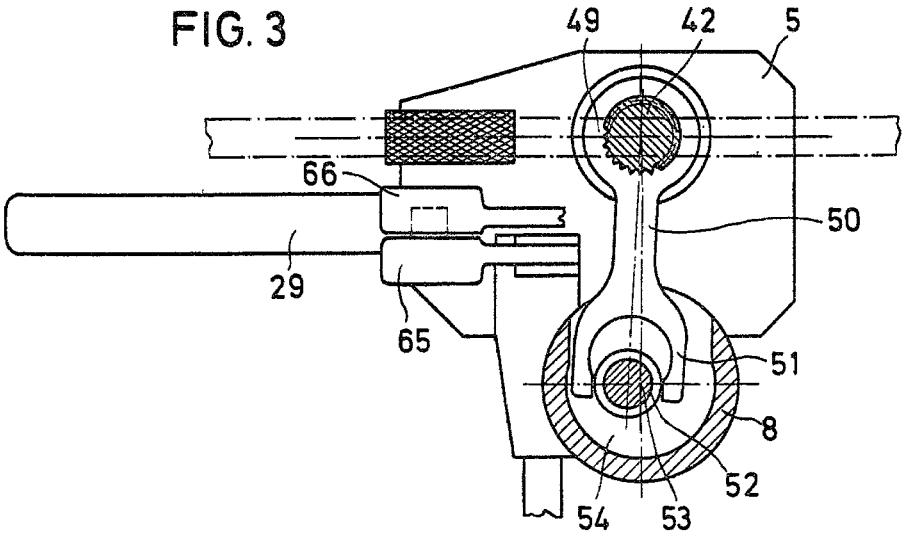
FIG. 3 a plan view of the apparatus of FIG. 1 with partly removed members.
Figure 4:
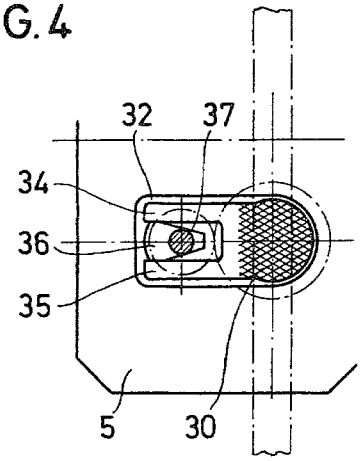
FIG. 4 a plan view of the base plate of the apparatus with the female die inserted.

As is in particular apparent from FIG. 2, a female die 30 provided with a pin 31 is pivotably mounted in base plate 5. Female die 30 is located in a recess 32 of base plate 5 and is supported by a bearing plate 33. As is apparent from FIG. 4, female die 30 has two arms 34, 35 surrounding a wedge-shaped coupling piece 36 of a shaft 37 mounted in base plate 5 and in casing 6. On shaft 37 is provided a gear wheel 38 which meshes with a toothed segment 39 arranged on the pivotably driven male die shaft 40. The latter has a base portion 41 mounted in a recess 43 by means of a bearing 44 and a top part 42 mounted in a bore 46 by means of a bearing 45. Top part 42 has a spline shaft 47 with the aid of which is coupled a lever 50 having a cotter slot 49 (FIG. 3). The end facing the cotter slot 49 of lever 50 has a fork member 51 around which engages a cam follower 52 of an eccentric shaft with an axis 53 given by the motor drive 8. Fork member 51 moves in a recess 54 provided in the motor drive 8. If the cam 52 rotates, the male die shaft 40 performs a pivoting movement transmitted via teeth 39 and gear wheel 38 to coupling piece 36, so that the female die 30 also moves, but in the opposite direction to the male die shaft 40.

By means of female die 30 a cutting blade 56 for cutting the strip 1 and a male die 55 are fixed to the bottom of the male die shaft base portion 41.

The male die shaft 40 is loaded by a compression spring 57 supported on the one hand on the base portion 41 and on the other via a plate 58 on casing 6. Base portion 41 has a shoulder 59 supported on a cross-member 60 if rocker 20 lowered into the tensioning position in FIG. 1 is raised for inserting the strip 1. Due to the upward pivoting of rocker 20 a strip clamping lever 61 on which is mounted cross-member 60 by means of a shaft 64, mounted on a shaft 62 and loaded by a compression spring 63 is raised, so that the central axis of cross-member 60 is moved into the dotted line position 60' and serves as a support for the shoulder 59 of base portion 41.

For applying elastic strip 1 to the object 2, it is necessary to have on the one hand a tensioning operation for tensioning strip 1 and on the other a welding operation for joining the overlapping strip portions 1'3, which are carried out in succession. In order to perform the operating cycle, two feeler levers 65, 66 are pivotably mounted on casing 6 (FIG. 3). Motor drive 8 is put into operation by the feeler lever 65 which has a finger 67 which engages under the feeler lever 66. Feeler lever 66 is part of a control mechanism 70 with a shaft 68 mounted in casing 6 and in casing attachment 21 and a pivotable multiple lever 69 mounted on shaft 68. Multiple lever 69 comprises feeler lever 66, a lifting fork 71 for raising the coupling member 11 to release claw coupling 11, 12 and a stop lever 72 to which is coupled a stop bolt 73 by means of a pin 74. By means of a compression spring 76 the stop bolt 73 is pressed against a recess 77 located in the upper part 42 of male die shaft 40 and it engages in the said recess when shaft 40 is raised by cross-member 60 on pivoting rocker 20.

The apparatus functions as follows. After inserting the plastic wrapping strip 1, rocker 20 and therefore tensioning wheel 25 are lowered by means of the rocker lever 23 onto strip 1. By means of feeler lever 65 the motor drive 8 is put into operation, after which the driving shaft 9 drives the tensioning wheel 25 via claw coupling 11, 12, worm gear drive 16, 17 and tooth wheel drive 27, 28, so that strip 1 is tensioned.

After reaching an adequate strip tension the feeler lever 66 and consequently the control mechanism 70 are actuated. As a result, the claw coupling 11, 12 belonging to the drive of the tensioning wheel 25 is released, so that wheel 25 is stopped. At the same time, stop bolt 72 is removed from recess 77, so that the male die shaft 40 is lowered by the tension of spring 57. As the tensioning wheel 25 remains lowered, the cross-member 60 is also lowered and strip portions 1', 3 are clamped by the strip clamping device 4.

As soon as male die 55 is pressed onto the strip portions by the tension of spring 57 both strip portions 1', 3 are engaged by the teeth of female die 30 and male die 55 and are moved backwards and forwards. Due to the resulting frictional movement, the two superimposed surfaces of the strip portions 1', 3 are softened and partly melted until they are bonded together.

At the end of welding, the feeler lever 65 is raised, so that the motor drive is stopped and the control mechanism 70 is brought into the initial position. Claw coupling 11, 12 is engaged again, whereas stop bolt 73 only engages in recess 77 after raising the shaft 40.

According to FIG. 2, both female die 30 and male die 55 are moved in opposite directions during the welding process. However, it is also possible for die 30 not to be driven. In this case, shaft 37 with coupling piece 36 and gear wheel 38 are rendered superfluous.

The tensioning process and welding process can also be performed automatically and in succession. Here again, the drive of the male die shaft 40 can be performed on a continuous basis by means of lever 50. This leads to a simplification of the apparatus without any disadvantage resulting, because the tensioning process during which the male die shaft 40 idles is relatively short.

If desired, the strip portions 1', 3 can also be welded with the rocker 20 raised. It is sufficient for rocker 20 to be raised only by a small amount.

As the pivoting movements of male die 55 and with female die 30 driven always take place about the axis of male die shaft 40 by changing the shape of the surface of female dies 30 and male die 55 an unequal heating on the friction surface can be achieved. If, for example, a continuously increasing heating towards the end of strip 1 is desired, the surface portion of die 30 or die 55 placed against the strip clamping device 4 can be moved back, so that there is no friction at this point. Due to the movement increasing from the axis of shaft 40 increasing softening and welding takes place.

The relative velocity between male die 55 and female die 30 can be increased by the drive of die 30. This makes it possible therefore either to reduce the frequency of the male die shaft drive or the welding time.

We claim:

1. An apparatus for placing a plastic strip around objects and for friction welding together overlapping strip portions thereof, comprising a base plate, a casing fixedly connected to said base plate, a motor having a drive shaft, a female die positioned in said base plate, a die shaft oscillatorily and shiftably positioned in said casing, a male die carried by said die shaft, a lever operably connected to said drive shaft having oscillating means for pivoting said die shaft, a rocker tiltably positioned on said casing and having a tension wheel for tensioning said strip, said tensioning wheel being driven via gearing and a coupling through said drive shaft, a control member positioned in said casing having a shifting lever to disconnect said coupling, and a stop lever to hold said die shaft in a raised position.

2. An apparatus according to claim 1, wherein there is provided a pivoting mechanism driven by the male die shaft for pivoting the female die.

3. An apparatus according to claim 2, wherein the pivoting mechanism is a shaft mounted in the casing and in the base plate and driven by a toothed segment on the periphery of the male die shaft via a gear wheel, said shaft having a coupling piece fixed thereto, and there are two arms on said female die engaging said coupling piece therebetween.

4. An apparatus according to claim 1, wherein there is a stop member operable by said stop lever which engages in a recess of said male die shaft and is provided for holding the male die shaft in a raised position.

5. An apparatus according to claim 4, wherein there is provided a feeler lever for operating said control member.

6. An apparatus according to claim 4, wherein there is provided a cross-member articulated to said rocker for lifting said male die shaft into a raised position.

7. An apparatus according to claim 1, wherein said female die has a friction surface which is only a partial surface, e.g. a rectangle located in the strip direction of the surface of the female die.

8. An apparatus according to claim 1, wherein the male die has a friction surface which is only a partial surface, e.g. a rectangle located in the strip direction of the surface of the male die shaft base portion.

* * * * *